United States Patent [19]

Ruckstuhl

[11] 4,166,583

[45] Sep. 4, 1979

[54] HAMMERMILL

[76] Inventor: Konrad Ruckstuhl, 1019 E. Easter Way, Littleton, Colo. 80122

[21] Appl. No.: 854,245

[22] Filed: Nov. 23, 1977

[51] Int. Cl.[2] ..... B02C 13/284; B02C 13/286

[52] U.S. Cl. ..... 241/73; 241/154; 241/187; 241/190; 241/241; 241/285 B

[58] Field of Search ..... 241/73, 154, 187, 189 R, 241/189 A, 190, 229, 241, 285 A, 285 B

[56] References Cited

U.S. PATENT DOCUMENTS

| | | | |
|---|---|---|---|
| 2,644,644 | 7/1953 | West | 241/187 X |
| 2,756,002 | 7/1956 | Brake | 241/285 B |
| 3,224,688 | 12/1965 | Beiter | 241/154 |
| 3,610,544 | 10/1971 | O'Connor | 241/154 X |
| 3,637,145 | 1/1972 | Williams | 241/189 A |
| 3,756,519 | 9/1973 | Reynolds et al. | 241/189 R X |
| 4,049,206 | 9/1977 | Konig et al. | 241/285 B X |

*Primary Examiner*—Howard N. Goldberg
*Attorney, Agent, or Firm*—Horace B. Van Valkenburgh; Frank C. Lowe

[57] ABSTRACT

Upper and lower rotors are offset in position, such as at an angle of 60°, between their centerlines, with the upper rotor having larger hammers and rotated at a lower speed than the lower rotor having smaller but a larger number of hammers. The feed is to the top of the upper rotor, and heavy interception bars extend perpendicularly to the centerline between the rotors and are disposed between the sets of hammers of the lower rotor, to prevent the entry of large objects into the lower rotor, to form an anvil against which objects on the bars are impacted by both the upper and lower hammers, with the lower hammers also "nibbling away" on the objects. A U-shaped corner formed of heavy armor plate is positioned next to the interception bars and extends between the circles of rotation of the hammer ends. A pivoted segment on the rear side of the upper rotor, having comminuting teeth on the inside, is held in closed position by heavy springs, but is adapted to be opened by the pressure of a large object, such as an automobile engine cylinder. Similar segments surround the remainder of both rotors, while the front segment opposite the pivoted segment for the upper rotor and the front, upper segment for the lower rotor are mounted in a pivoted housing panel, which may be moved hydraulically to pivot to a forward and downward position, for inspection and maintenance of the hammers. A screen at the bottom of the lower rotor may be removed for inspection by sliding in grooves in arcuate mounting blocks, to a position above the lower parting line between the main housing and the pivotal panel. Several variations in the screens and hammers, particularly of the lower rotor, are also disclosed.

25 Claims, 21 Drawing Figures

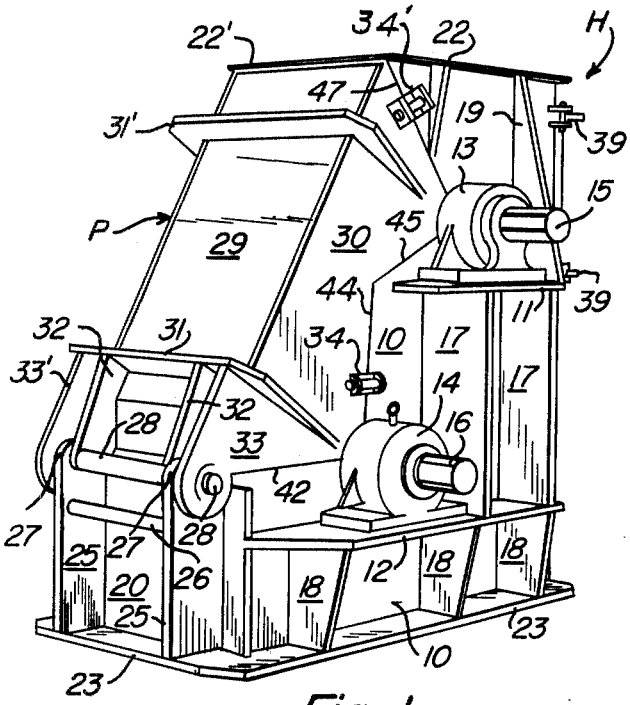
Fig-1
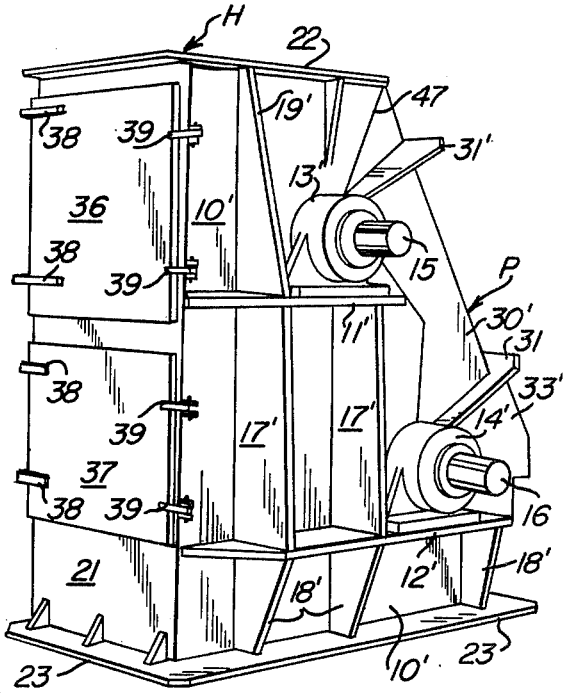
Fig-2
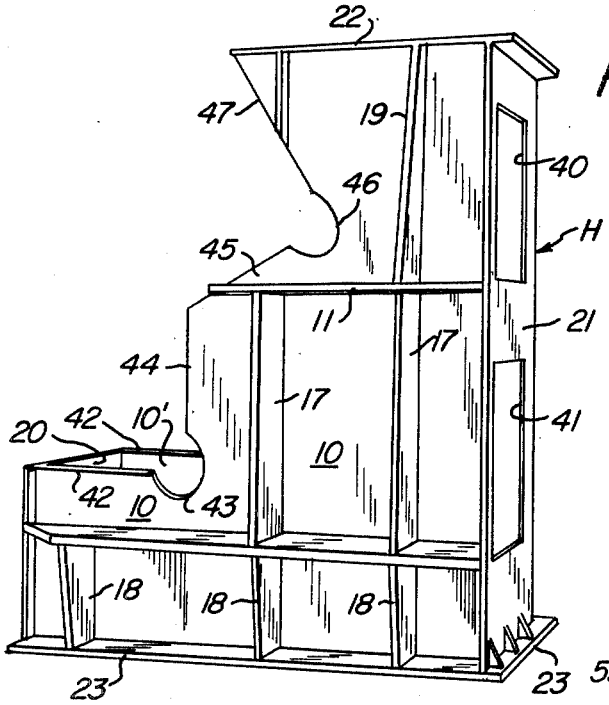
Fig-3
Fig-4
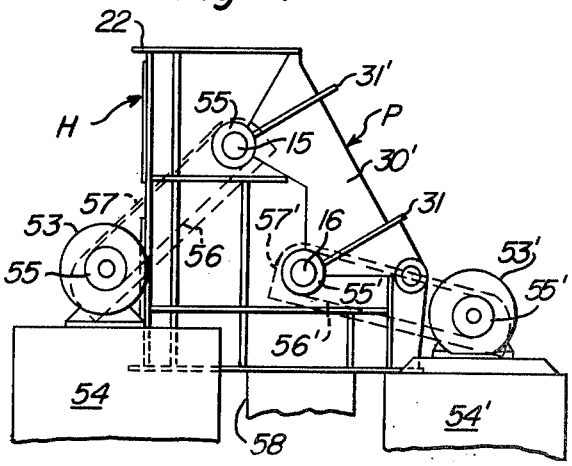

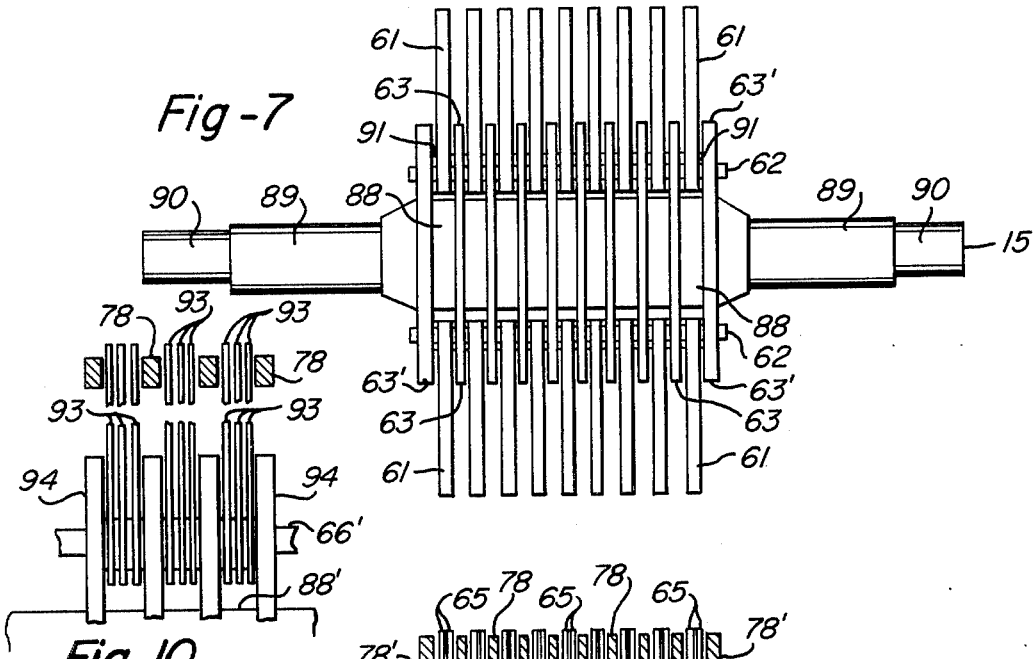
Fig-7
Fig-10
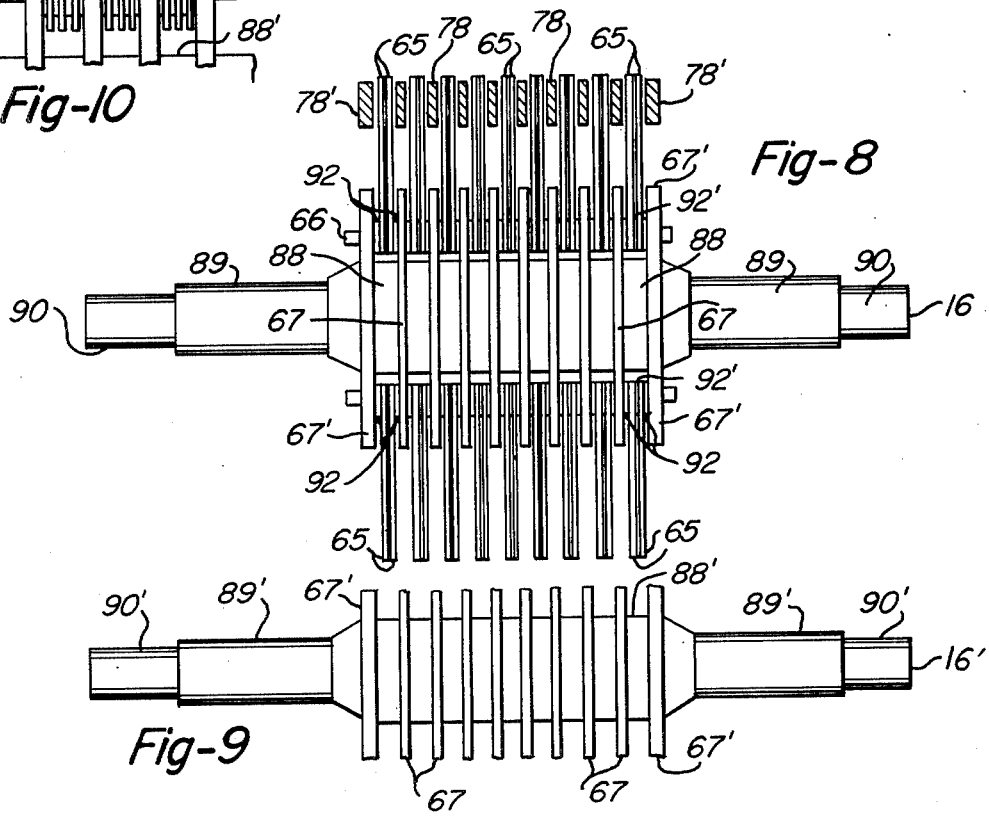
Fig-8
Fig-9
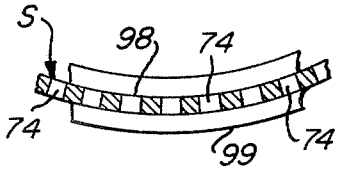
Fig-15
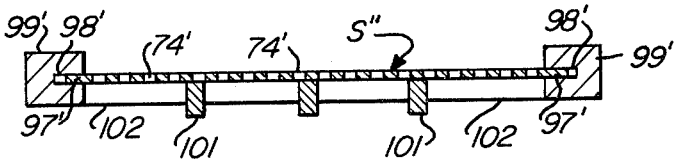
Fig-16

Fig-12
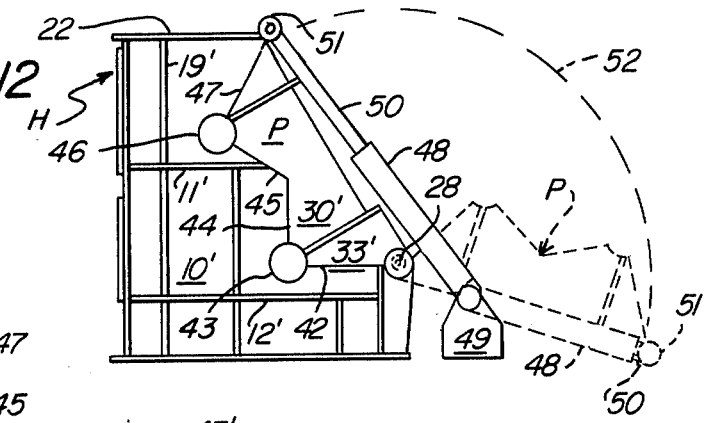
Fig-11
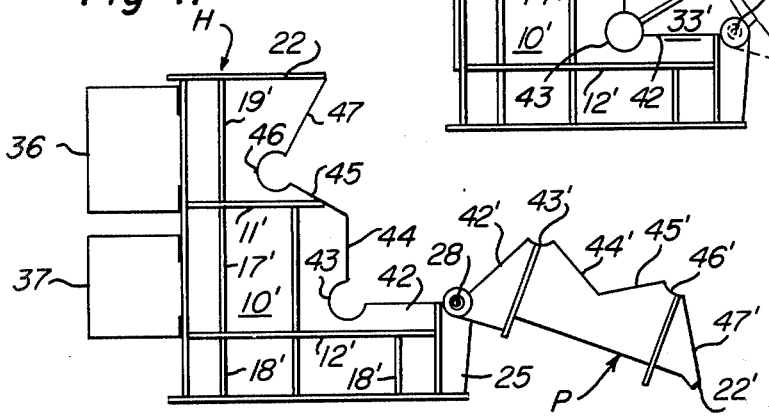
Fig-13
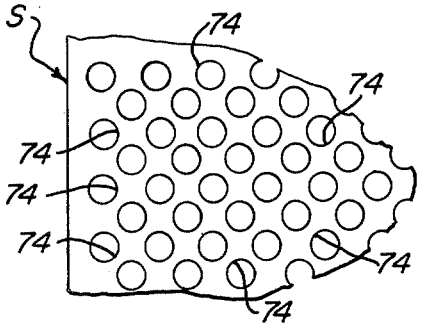
Fig-14
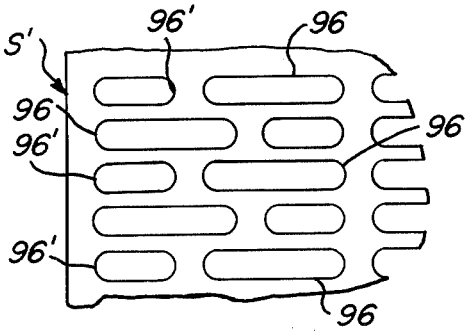
Fig-17
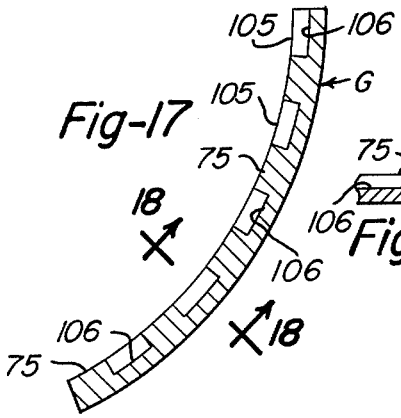
Fig-18
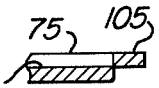
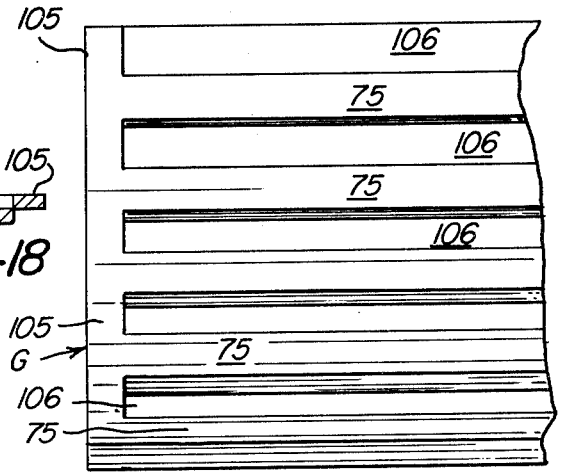
Fig-19

HAMMERMILL

This invention relates to hammermills, and more particularly to a double rotor hammermill which may achieve comminution or pulverization of brittle material, shredding of tough material and flaking or defiberizing of fibrous material.

BACKGROUND OF THE INVENTION

Numerous types of hammermills and other kinds of machines for grinding, disintegrating or shredding are known for the pulverizing, shredding, defiberizing or flaking of various types of materials. There are numerous applications which a single rotor hammermill is not capable of performing satisfactorily, so that a plurality of single rotor hammermills are used in succession. One problem encountered generally in single rotor hammermills, utilized for treating waste material, is their inability to pulverize or comminute waste paper when in wet condition, as well as the tremendous cost of maintenance, often requiring the installation of approximately 50% greater capacity, because of the necessity for frequently rewelding the hammers, such as after only 16 hours of operation. In an attempt to overcome at least some of the difficulties of single rotor hammermills, double rotor hammermills, in a horizontal arrangement, have been designed but have proven to be a good compromise, rather than a satisfactory solution. A special advantage of multi-rotor hammermills is the so-called impact zone between the rotors, in which the material is projected from one rotor against the stream of material projected by the other rotor, and due to this impact zone, double rotor hammermills are less dependent on the hammers having sharp edges and thus require less rewelding. However, in order to avoid excessive grinding action, it has been necessary to arrange a discharge screen for each rotor immediately below the impact zone or area of contiguity between the two rotors. It is also possible to arrange screens below the second rotor at a position spaced circumferentially from the impact zone, but the position of such screens has not yielded the same throughput or as fast an extraction as screens immediately below the impact zone. There is also a possibility that screens remote from the impact zone may choke up or material may slowly build up on them, because such screens are not exposed to the self-cleaning action of the two streams of material projected by the two rotors. Screens at the upper part of the impact zone of the rotors have also been tried, but have proven satisfactory only for material which is quite hard and relatively easy to grind or shatter, since it has not been satisfactory for tough, moist or otherwise difficult material which requires repeated passage through the impact zone until ground finely enough. Suction has also been applied to such overhead screens but has proven to be too close to the feed opening and has upset the balance of the flow around the two rotors.

Additional difficulties with horizontal multi-rotor hammermills have included the inspection and maintenance problem, since access to the hammers and the screens, which are the principal parts requiring periodic inspection, requires the removal of parts surrounding the rotors and requires the removal of numerous cover plates to obtain access thereto. Multi-rotor hammermills in which a first rotor is placed directly above a second rotor have also been tried to improve the ease of access to the rotors. However, these have proved to be vulnerable to vibration, because of insufficient anchorage support of the upper rotor and the increasing amount of vibration caused by both rotors when the hammers begin to show different wear patterns.

All known hammermills, including multi-rotor hammermills, are subject to damage due to heavy tramp metal or other nearly indestructible objects, such as an engine block, getting into the grinding area and particularly into the impact zone of multi-rotor hammermills. Thus, such hammermills have been unable to grind critical material, such as city refuse, finely enough in one stage. As a result, it has been necessary to equip all hammermills subject to this danger and designed to grind to a comparatively small size, with relatively large openings to permit quick discharge of material which cannot be quickly disintegrated.

Among the objects of this invention are to provide a novel multiple rotor hammermill in which the comminuting or grinding action is improved; to provide such a hammermill which is capable of comminuting or grinding wet material, particularly waste paper; to provide such a hammermill which is capable of simultaneously comminuting or grinding numerous different types of material, including hard material, such as glass, ceramic, stone and the like, cellulosic fiber materials, such as newspaper waste, whether wet or dry, relatively soft material, such as food waste or lawn waste, plastic, rubber, leather, aluminum and other nonferrous material, as well as ferrous material when desired; to provide such a hammermill in which access to various parts for inspection or maintenance is greatly facilitated, and particularly for the hammers and screens; to provide such a hammermill in which heavy metal objects passing into the impact zone and likely to cause considerable damage may be automatically ejected; to provide such a hammermill which will combine the advantages of conventional double hammermills without having their shortcomings; to provide such a hammermill in which the impact of the hammers of the second rotor on material being comminuted by the first rotor is enhanced with the material not necessarily passing completely into the area of the second rotor; to provide such a hammermill in which each rotor may be adequately supported and thus resistant to the effects of vibration; and to provide such a hammermill which will be efficient and effective in use and reliable in operation.

SUMMARY OF THE INVENTION

Upper and lower rotors have horizontal axes, with a line between the centerlines at an acute angle to the horizontal, such as 60°. Each rotor includes hammers in rows pivoted on hammer shafts carried by discs mounted on a central shaft, with the circles of rotation of hammer outer ends approaching each other at the above line. Adjacent thereto is interception means, such as heavy bars perpendicular to the above line and interspaced between the lower hammers, for acting as an anvil and for preventing objects of a predetermined size, such as greater than the spaces between the bars, moving into the lower grinding area. During rotation, the hammers of the lower rotor extend past the bars to engage objects or pieces propelled by the upper hammers, as well as to nibble away at objects retained by the interception means. At each side, a U-shaped corner, formed of heavy armor plate, is positioned between the hammer rotation circles. The interception means permits a grinding screen, through which is discharged material ground to a desired size, to be placed below the lower rotor, while the remainder of the periphery of each of the rotors, except for the heavy corners and an inlet above the rear half of the upper rotor, is occupied by arcuate comminuting or grinding segments, such as having transversely parallel, inwardly extending teeth. A rear segment of the upper rotor, below the inlet, is pivoted and held in normal closed position by resilient means, such as heavy springs of either the coil or leaf variety, so that a large object, which might jam the machine, will be discharged by opening of the pivoted segment when sufficient pressure is exerted against it by the upper hammers. An oblique housing panel is pivoted forwardly and downwardly, preferably hydraulically, to permit inspection of the rotor hammers, and may also carry appropriate comminuting and grinding segments. The parting line between the housing and the panel extends from a point adjacent the horizontal centerline of the lower rotor, across the apertures for the shafts of each of the rotors, then to a point above the upper rotor. The rear of the housing is provided with doors which may be swung open for inspection or repair purposes. Bearings for the rotor shafts are supported at laterally spaced positions on the sides of the housing, while for higher speeds of rotation and the use of bearings of lesser diameter, a lower shaft of a lesser diameter may be utilized to reduce the rotating weight, as well as thinner hammer supporting discs and shafts. The normal complement may be single hammers between discs for the upper rotor and dual hammers, of one half the thickness of the upper hammers, for the lower rotor, while the weight of the hammers themselves may be reduced, such as by using multiple but thinner hammers between each pair of discs, the latter being suitable for cellulosic material, such as paper. Another type of hammer, particularly suitable for paper, has a transverse blade attached to the outer end, having a cutting edge facing in the direction of movement, such hammers being pivoted or fixed but should not extend past the interception bars. The edges of the grinding screen, removable for inspection with the housing panel in open position, are slid upwardly in arcuate grooves of side blocks. A grinding segment, above the screen and extending up to the front parting line, may have arcuate, lateral flanges for engaging the slots in a continuation of the screen mounting blocks.

THE DRAWINGS

The foregoing and additional features of this invention will become apparent from the description which follows, taken in conjunction with the accompanying drawings, in which:

FIG. 1 is a three quarter front perspective view of a hammermill constructed in accordance with this invention, prior to installation on a foundation and the connection of drive means.

FIG. 2 is a similar three quarter rear perspective view of the hammermill.

FIG. 3 is a three quarter rear perspective view, showing the opposite side from FIG. 2, of a housing of the hammermill.

FIG. 4 is a side elevation of the hammermill, on a reduced scale, showing particularly the drive for the rotors.

FIG. 7 is a side elevation of the upper rotor.

FIG. 8 is a side elevation of the lower rotor showing also, in section, the interception bars of FIG. 6.

FIG. 9 is a side elevation of a rotor shaft of lesser diameter and requiring a smaller diameter bearing, with hammer discs shown fragmentarily.

FIG. 10 is a fragmentary condensed side elevation of a portion of a rotor having alternative hammers, particularly adapted to be utilized with the shaft of FIG. 9.

FIG. 11 is a side elevation of the housing of the hammermill, showing an oblique front panel pivoted forwardly and downwardly and rear doors pivoted to an open position, for inspection and maintenance purposes.

FIG. 12 is a view similar to FIG. 11 but with the panel in closed position and showing a hydraulic mechanism for moving the panel to and from the open dotted position.

FIG. 13 is a fragmentary plan view of a screen through which comminuted material is discharged from the lower rotor.

FIG. 14 is a fragmentary plan view of an alternative screen.

FIG. 15 is an enlargement of a fragmentary portion of FIG. 5 but omitting the rotor and showing particularly an arcuate block for slidably mounting a screen disposed at the periphery of the lower rotor.

FIG. 16 is a transverse cross section of a screen thinner than the screen of FIG. 15 but similarly slidably mounted and showing a support for the screen.

FIG. 17 is an enlarged fragmentary section of a grinding segment associated with the lower rotor and corresponding to a portion of FIG. 5.

FIG. 18 is a fragmentary cross section taken along line 18—18 of FIG. 17.

FIG. 19 is a plan view of the segment portion of FIG. 18.

DESCRIPTION OF THE PREFERRED EMBODIMENT

Figure 5:
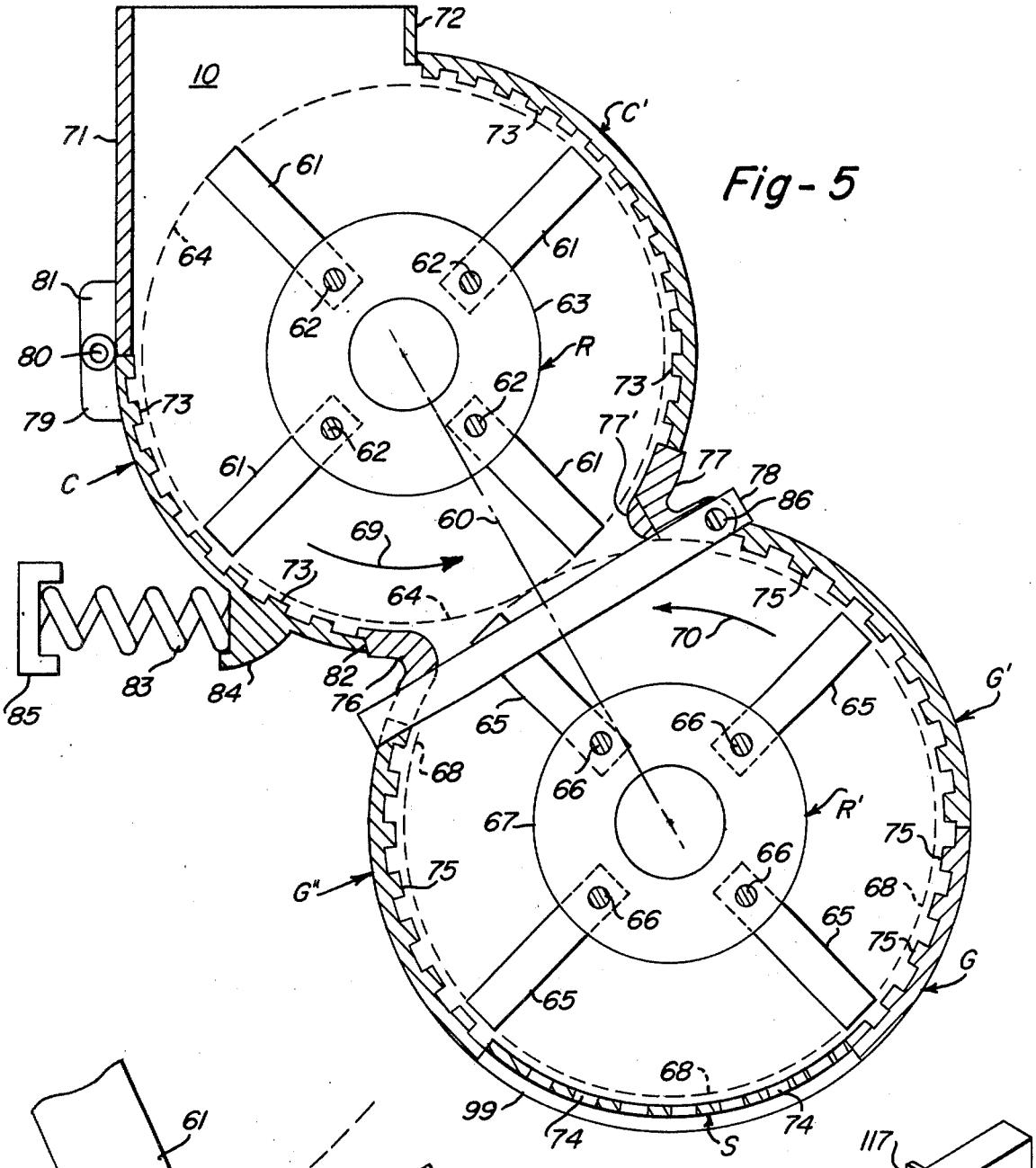
FIG. 5 is an internal vertical section showing upper and lower rotors and parts cooperating therewith.

A hammermill constructed in accordance with this invention may include rotors R and R′ and associated parts of FIGS. 5, 7 and 8, installed within a housing H of FIGS. 1 and 2, with a pivoted panel P utilized for inspection and maintenance purposes, as will hereinafter appear, but shown in open position in FIG. 11. The housing H includes side plates 10 and 10′, on which are mounted respective upper platforms 11 and 11′ and lower platforms 12 and 12′. Upper bearings 13 and 13′ and lower bearings 14 and 14′ are mounted on the respective upper and lower platforms, while an upper shaft 15 is supported by the upper bearings, and a lower shaft 16 is supported by the lower bearings. Upper platforms 11 and 11′ are supported by ribs 17 and 17′ extending upwardly from the lower platform, in turn supported by ribs 18 and 18′, with ribs 17 and 17′ being directly above two of ribs 18 and 18′ and additional reinforcing ribs 19 and 19′ extending upwardly from the respective platforms 11 and 11′. Housing H includes a front plate 20 and a rear plate 21, while a top flange 22 extends around the top. A base plate 23 extends around the lower periphery of the housing H and is attached to the lower edges of the side, front and rear plates, as well as the lower edges of ribs 18 and 18'. The various plates and ribs may be attached together in a suitable manner, as by welding, and the housing parts may be reinforced by additional ribs, as shown.

A pair of upright ribs 25 are attached in spaced relation to the front plate 20 and are reinforced by a cross bar 26, so that each may carry, at its upper end, a bearing 27 for a pivot shaft 28 of the panel P, by which the panel is pivoted downwardly and forwardly to the position of FIG. 11, for inspection and maintenance purposes. Panel P includes a front plate 29 and side plates 30 and 30' which extend downwardly to the lower edge of the panel and which are reinforced by U-shaped ribs 31 and 31', the former near the lower end of panel P and the latter near the upper end. Rib 31 is further attached to the front plate and to the pivot shaft 28 by ribs 32, each just inwardly from a bearing 27, and also by extensions 33 and 33' of the side plates 30 and 30', which extend forwardly and downwardly to include a hole through which the pivot shaft 28 extends. Toggle locks 34 and 34' permit the panel P to be attached securely to the housing H, when in the closed position of FIG. 1. Upper and lower doors 36 and 37, respectively, are pivotally mounted by hinges 38, as in FIG. 2, at the rear of housing H and are secured in closed position by latches 39, so that the doors may be swung away from the housing to the open position of FIG. 10, for inspection and maintenance purposes. The doors cover respective upper and lower openings 40 and 41, as in FIG. 3, in rear plate 22 of the housing H.

For engagement with panel P, the front plate 21 and the front portions of side plates 10 and 10', as also shown in FIG. 3, extend upwardly to a horizontal parting line 42 at the front and each side in alignment with the center of an arcuate opening 43, such as 270°, which accommodates the extension of lower shaft 16 through the housing. From the vertical upper point of opening 43, a vertical parting line 44 extends upwardly to a rearwardly angled parting line 45, as at an angle of 45° to the horizontal, which intersects the centerline of an arcuate opening 46, such as 270°, which in turn accommodates extension of the upper shaft 15 through the housing. Finally, from the vertical upper point of opening 46, a forwardly and upwardly angled parting line 47 extends to a top flange portion 22'. As in FIG. 11, the edges of side plates 30 and 30' of panel P are provided with parting lines 42', 44', 45' and 47' adapted to abut in closed position against the respective parting lines 42, 44, 45 and 47 of housing H. In addition, panel P is provided with arcuate openings 43' and 46', such as 90°, adapted to close the circles of the respective arcuate openings 43 and 46 of the housing H around the respective shafts, while toggle locks 34 and 34' extend across the parting lines 44 and 47.

Panel P may be moved by a chain hoist or other suitable device between the closed and open positions, but is conveniently moved hydraulically, as in FIG. 12, between the closed full position and the dotted open position shown. Thus, a hydraulic cylinder 48, at each side of panel P, may be pivotally mounted on a support 49 and is preferably double acting, so as to move a piston rod 50 inwardly and outwardly, between the extended full position and the retracted dotted position shown and vice versa. The outer end of piston rod 50 is pivotally connected to an ear 51 mounted on the upper end of panel P and will describe an arc 52, shown in dotted lines, in moving from the closed position to the open position of panel P and vice versa. As will be evident, the pivot point for cylinder 48 should be forwardly of the position of shaft 28, and also sufficiently lower than shaft 28 to produce pivotal movement of panel P at both closed and open positions.

A drive motor 53 for the upper shaft 15 and a drive motor 53' for the lower shaft 16, as in FIG. 4, are mounted on foundations 54 and 54', respectively. Pulleys 55 and 55' are mounted on the respective upper and lower rotor shafts and motor shafts, while the respective pairs of pulleys are connected by belts 56 and 56', indicated by dotted lines, and a conventional cover 57 and 57' provided for each belt, again indicated in dotted lines. An outlet 58 may extend downwardly from the hammermill, as through a foundation, not shown for clarity of illustration.

The hammermill further includes rotors R and R' which, in accordance with this invention, are mounted in an oblique arrangement, as in FIG. 5, with a centerline 60 between the rotor shafts 15 and 16 extending at an acute angle, such as 60° to the horizontal. The upper rotor R includes, as in FIGS. 5 and 7, a series of hammers 61 pivotally mounted on hammer shafts 62 and supported by discs 63 mounted on shaft 15. During rotation of shaft 15, such as from 1000 to 1500 r.p.m., the hammers 61 will be thrown outwardly by centrifugal force, with the outer ends of the hammers, in the absence of striking an object, rotating in a dotted circle 64. Upon rotation of lower shaft 16, as between 1500 to 2200 r.p.m., hammers 65 will be pivoted outwardly on hammer shafts 66, extending through discs 67, in turn mounted on shaft 16, and will be thrown out by centrifugal force, so that the outer ends of the hammers will travel in a dotted circle 68. At the centerline 60, between the rotor shafts, the dotted lines 64 and 68 will closely approach each other as the hammers move in opposite directions, although the shafts 15 and 16 rotate in the same direction, as indicated by the arrow 69 for the upper rotor and an arrow 70 for the lower rotor. The slower rotating, upper hammers 61 are made thicker, as on the order of 1½ inches, than the faster rotating, lower hammers 65, as on the order of ¾ inch, since the upper hammers are designed to produce coarser shredding or pulverizing and the lower hammers a finer grind. Also, the upper hammers are spaced farther apart, with one upper hammer between each pair of discs 63, as in FIG. 7, while there may be two spaced lower hammers between each pair of discs 67, as in FIG. 8. The ends of the hammers of the rotors should also approach each other as closely as possible, as on the order of ⅛ inch distance between circles 64 and 68.

A rear wall 71 and front wall 72 of a rectangular inlet extend downwardly to the periphery of the rotation of the rotor hammers, rear wall 71 conveniently extending to a point adjacent the circle 64 at the rear and front wall 72 being essentially directly above the centerline of shaft 15 at the front. The side walls of the inlet are, of course, formed by the side walls 10 and 10' of housing H, although wear plates attached to the inside of the housing and panel P at the end of each rotor may be utilized.

At the rear and below the inlet rear wall 71 is a pivoted, arcuate comminuting segment C, which may extend for slightly less than 90°, while opposite the segment C and extending downwardly from the lower edge of inlet front wall 72 is an arcuate comminuting segment C', which is stationary during use but may be mounted on the inside of panel P. Segments C and C' are provided with parallel, inwardly extending teeth 73 which are spaced apart, forming slots, a distance correlated with the depth of the ribs to correspond to the desired comminuting action. Also, the inner surface of teeth 73 are spaced from the hammer circle 64 as slight a distance as functionally possible, as on the order of ⅛ inch. A grinding screen S, through holes 74 in which the material ground to a sufficiently small size is discharged, occupies an arcuate area, as on the order of 80°, around the lower periphery of lower rotor R'. A grinding segment G extends upwardly from the front edge of screen S to the horizontal centerline of rotor R', for a purpose later described, while mounted above segment G is another grinding segment G' but which may be mounted on the inside of panel P. On the opposite side of rotor R', a grinding segment G'' is mounted in a stationary position above screen S. The grinding segments around rotor R' are provided with parallel, spaced teeth 73' corresponding to teeth 73 of segment C, but may have a slightly lesser width and spacing because of the finer grind desired.

In further accordance with this invention, in the area at each side adjacent the area of closest approach of the circles 64 and 68, as well as between the circles, i.e. bounding the impact area, are corresponding, heavy impact corners 76 and 77, which may be U-shaped, as shown, and are formed of armor plate or similar high strength, high impact material. Each of the impact corners 76 and 77 is in a position to receive the impact of material propelled around by hammers 61 or 65 which does not strike an oppositely moving hammer.

In still further accordance with this invention, interception means is interposed between the two rotors for a multiple function. One function is to prevent any object which is larger than a predetermined size from proceeding into the balance of the area in which the lower rotor hammers rotate, thereby relieving the rotor R' of a heavier load which might be occasioned by a larger object being thrown by the rotor R into that area. A further function is to provide an anvil effect, on which objects thrown by rotor R may tend to be retained, for repeated impacts by the hammers of both rotors R and R', while another function is to position such objects so that the ends of the lower rotor hammers may nibble away at them, as it were, to remove smaller pieces without the necessity of the lower rotor hammers carrying such objects around with them. Another function is to permit wet material, such as waste paper, to be shredded into fibers, without being carried around by the lower rotor hammers, while a further function is to permit placement of a discharge screen at a position remote from the impact area but avoid clogging or build-up of material on the screen, or damage by large objects. A further function is to position relatively hard objects, such as ceramic, glass, stone and the like, for maximum impact by the ends of the lower rotor hammers 65, when such objects are sufficiently large in size to be retained by the interception means. For providing such functions, the interception means conveniently comprises a series of heavy parallel bars 78 which are perpendicular to centerline 60, interspaced with the lower rotor hammers, as in FIG. 8, and against which objects are thrown by the upper hammers 61 and also against which the ends of lower hammers 65 collide, from the opposite direction. Thus, larger objects are stopped by the bars 78, so that they are impacted by both the upper and lower hammers and also the ends of the hammers 65 may nibble away at them, as it were, to remove increments of such an object in a small enough size that the increments may pass between the bars and be carried around with the hammers 65 for further grinding or comminution in the area in which the lower rotor R' rotates. These bars are stationary and contribute considerably to the ability of the hammermill of this invention to grind numerous articles, including larger objects as well as smaller objects.

Figure 6:
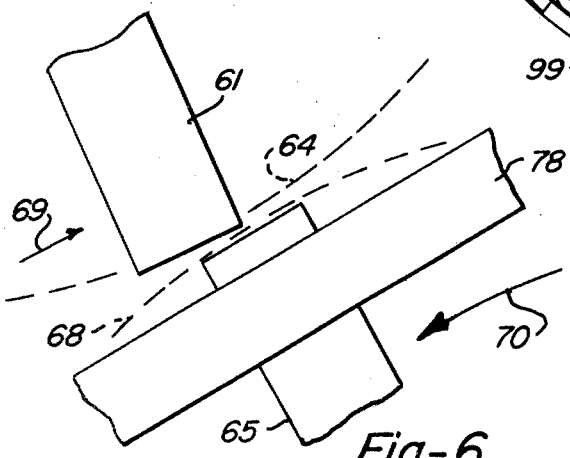
FIG. 6 is a fragmentary enlargement, corresponding to a central portion of FIG. 5 but illustrating the passage of a hammer of one rotor past a hammer of the other rotor, particularly in relation to interception bars adjacent thereto.

The action of the bars 78 in association with the hammers 61 and 65 is also illustrated in FIG. 6, in which a hammer 61 is shown in a position passing a hammer 65, or vice versa, at the closest approach of the hammer circles 64 and 68. The amount of the end of a hammer 65 which extends beyond bar 78, at the point of closest approach to upper hammer circle 64, as shown in FIG. 6, may vary, but distances on the order of ¼ inch to ½ inch may be found normally appropriate. Thus, as will be evident, an object propelled by a hammer 61 in the direction of arrow 69, when encountering a hammer 65 travelling in the opposite direction, i.e. in the direction of arrow 70, will receive what might be referred to as a double impact, due to its inertia from being impelled by a hammer 61 and the inertia of the hammer 65 travelling in the opposite direction. Also, an object propelled in one direction by one or more hammers 61 may collide with an object propelled by the ends of one or more hammers 65. In either event, the shatter effect is particularly advantageous in the case of relatively hard material. In addition, it will be evident how an object larger than the space between bars 78 and forced against bars by one or more hammers 61 will tend to be retained against the bars and to be nibbled at by hammers 65, as the ends of the hammers beyond the bar 78 engage the object. As will be further evident, other functions of the interception means will be aptly performed by the bars 78.

Although ferrous objects and particularly large ferrous objects which may be removed magnetically are desirably separated from the feed, it may happen that a relatively large object, such as an automobile engine cylinder block, may find its way through the inlet. Such an object may tend to jam the hammermill and prevent the desired action of the hammers, but the pivoted segment C is adapted to permit such an article to be discharged, upon the exertion of sufficient pressure against it. Thus, the segment C is pivoted, as at each side, by a hinge 79 on a pin 80, which is also mounted in an ear 81 extending from the rear wall 71 of the inlet. At the opposite edge, segment C and corner 76 are provided with a bevel seat 82, to make sure that this edge of the segment will fit snugly against the corner and also will return to a snug fit after the object causing the pressure against the segment has been discharged. One or more heavy coil springs 83 normally maintain the segment C in closed position, but permit the segment to open upon sufficient pressure. The inner end of each spring 83 may engage an abutment 84 formed integrally with or attached, as by welding, to the segment at the position of each spring 83. The opposite end of spring 83 may abut a heavy cup 85 which is stationary and attached to a suitable support inside the housing H. Heavy leaf springs may be substituted for coil springs 83.

As indicated previously, the segment C' and the segment G' may be mounted on the inside of panel P, while inlet front wall 73 and an outer portion of corner 77 may be similarly mounted inside the panel to facilitate access to the hammers, but an inner portion 77' of bar 77 should be welded between the sides of housing H to stabilize the corner at the intersection of parting lines 44 and 45. However, bars 78 should be separate from the panel for greater stability during use, while corner 76 should be welded between the sides of the housing H. When the panel P is moved to the open position of FIG. 11, the segments C' and G', corner 76, the outer portion of corner 77 and wall 72 are, of course, also moved with it. When the bars 78 are left in position, the rigidity of the bars will hold them in position, due to the absence of any load, when the panel is open. However, the panel P may be equipped on the inside with a socket having slots corresponding to the ends of bars 78 and locks against them, when the panel P moves into closed position. Also, bars 78 may be attached to corner 77, as by a bolt 86 which extends through the adjacent leg of corner 77 and the housing for removal from outside the housing before panel P is swung open and replacement after the panel is closed. Corner 77 may be provided with notches for engaging the bars 78, while both corner 76 and segment G'' may be provided with similar notches for engaging bars 78 adjacent their corresponding ends.

In FIGS. 7 and 8, an essentially conventional rotor construction is shown, with a central row of hammers being omitted in each view for clarity of illustration of shafts 15 and 16. A central section 88 of each shaft is relatively heavy and is flanked on each side by a bearing section 89 of sufficient length and diameter to withstand the bearing stresses imposed when the rotor is rotating at full speed and encounters an object which has just been fed into the comminution space. At each end, the shaft is provided with a smaller section 90, one of which carries the pulley 55 of FIG. 3 and the other of which carries a flywheel, not shown because of its being conventional in nature. The discs 63 of the upper rotor R are mounted on the shaft section 88 in a conventional manner, as by a shrink fit, but with each outside disc 63' having a greater thickness than the remainder of the discs. The hammers 61 are mounted on hammer shafts 62 in a conventional manner, as with one hammer between each adjacent pair of discs 63 and spacing rings 91 between each hammer 61 and the adjacent disc. On the lower rotor R', the hammers 65 are mounted in pairs on shafts 68, between each adjacent pair of discs 67, again with the outside discs 67' being thicker. However, each hammer 65 is pivotally mounted on the corresponding hammer shaft 67, with a spacing ring 92 between each hammer and the adjacent disc and a spacing ring 92' between each pair of hammers. As described previously, the bars 78 extend between each pair of hammers 65 opposite the corresponding discs 67 and again with the outer bars 78' being thicker. The bars 78 and 78' are, of course, fixed at the lower end and are stabilized at the upper end by the bolt 86 of FIG. 5.

With heavier loads, it may be necessary to utilize shafts 15 and 16 having large central sections 88 and corresponding large bearing sections 89. Such bearing sections are satisfactory for shaft 15, which may be rotated at 1000 to 1500 r.p.m., and for shaft 16, if rotated at no more than 1800 r.p.m., but for higher speeds produce difficulties for the larger bearings. Thus, if speeds of greater than 1800 r.p.m. are desired, it may be necessary to reduce the diameter of the bearings and concomittantly the weight of the shaft and diameter of its sections. Thus, shaft 16' of FIG. 9 is provided with a smaller center section 88' and smaller bearing sections 89'. When smaller bearings are substituted for bearings 14 of FIGS. 1 and 2, no change need be made in the housing or in the bearing platforms 12 or 12', since suitable shims may be placed under the smaller bearings. Discs 67 and 67' and hammer shafts 66 may be similar to those described above, or perhaps slightly narrower. Also, hammers 65 may be used, but the rotating weight may be additionally reduced by using thinner hammers 93 of FIG. 10, as on the order of 1/16 to ⅛ inch thick. Three of such hammers may be installed between adjacent discs 94, which may be correspondingly narrowed, although shown at an enlarged scale in FIG. 10, while hammer shafts 66' may be correspondingly reduced in diameter. Suitable spacing rings, as shown, may be interposed between adjacent hammers and at discs adjacent hammers. As will be evident, the interception bars 78 reduce sufficiently the size of objects which may pass to the lower rotor and therefore permit thinner hammers and higher speeds. The thinner hammers 93 of FIG. 10 are also particularly useful for grinding wet or moist fibrous material.

The holes in the screen S may vary considerably in configuration, location and size. Thus, the holes 74 of screen S illustrated in FIG. 13 are round and spaced apart in staggered rows a distance sufficient in relation to their size to cover approximately 45% to 50% of the surface of the screen. However, the holes 96 and 96' of alternative screen S' of FIG. 14 are slots and occupy a somewhat similar proportion of the surface of the screen, although the width of the slots may be reduced and/or the spacing between the slots increased to reduce the proportion of the screen area covered by the slots. The slots 96 of FIG. 14 appear to be more effective in grinding fibrous material, such as waste paper. A thinner screen S'' of FIG. 16 may also be used, particularly with the thinner hammers of FIG. 10.

When the panel P is moved to the open position of FIG. 11, both of the rotors will be exposed, with the hammers hanging down. Thus, each hammer of each row may be pulled up for inspection and the total number of rows exposed to view, by rotation of the rotor shafts, as by hand or with a jack. Any hammers that are found to be in need of repair may be replaced by slipping the corresponding shaft laterally a sufficient distance, in either direction, to permit the removal and replacement of the particular hammer. It will be noted that, with the panel P in the open position of FIG. 11, the configuration of the parting lines between the housing and the panel is such that the upper right shaft of both the upper and lower rotors of FIG. 5 can be moved laterally without any impedance by the housing. In addition to the hammers, the other part which should be inspected, since it is normally subject to wear and also the holes of which should be checked to make sure that the fineness of grind is maintained, is the screen S. As in FIGS. 15 and 16, an edge 97 of the screen may fit into a groove 98 in an arcuate block 99 which is mounted in fixed position in the housing H at each side of the screen and permits the screen to be moved around in the grooves 98 until it can be removed completely from the housing. The grooves 98 in arcuate blocks 99 are thicker for screen S, such as ¼ inch in thickness, than for screen S'', although the removal of the screen for inspection, as well as replacement, are essentially the same in each instance. When the thinner screen S'' is utilized, a support is conveniently provided, such as a series of arcuate, circumferentially extending bars 101 spaced sufficiently close together to resist deflection of the screen which might unduly increase the clearance between the screen and the ends of the hammers to reduce the effectiveness of the grinding action.

For a screen 30 inches wide and ⅛ inch thick, for instance, bars 101 may be on the order of ¾ inch thick and 1½ inches deep and spaced about 6 inches apart. Bars 101 may extend from a cross bar 102 at one end of the screen to a similar cross bar at the other end of the screen, which cross bars may be integral with or attached to arcuate blocks 99 or independently attached between the housing sides.

To provide readier access to the screen S for removal, the arcuate block 99 with its slot 98 may extend at each side up to the parting line 42 of the housing H, i.e. the centerline of the lower shaft 16. Since the grinding segment G' of FIG. 5 is mounted in the panel P, the grinding segment G need extend only to the centerline of the lower rotor R'. As in FIGS. 17–19, the grinding segment G may be provided with a lip 105 which is integral with the ribs 75 and has a thickness corresponding to that of the screen S, so that the arcuate lip 105 will fit into the same groove 98 in guide block 99 as does screen S, as in FIG. 16. As shown, flanges 105 of segment G have the same thickness as the depth of slots 106 between ribs 75, but if the depth of slots 106 should differ, then the thickness of flanges 105 should have the same thickness as screen S. As will be evident, it is very simple to first remove grinding segment G by sliding it along the guide block 99, prior to removing the screen S. Alternatively, screen S could extend to a point closer to the parting line 42 of FIG. 3 and segments G become merely one or two bars, each comprising a tooth 75 and a slot 106 and thereby be readily attachable to and removable from housing H, as well as holding screen S more securely in position.

Figure 20:
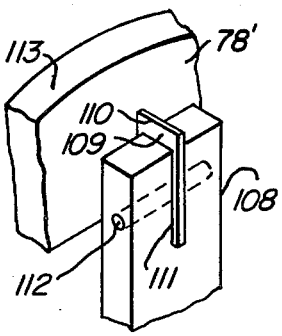
FIGS. 20 and 21 are fragmentary enlargements on a scale similar to FIG. 6 but showing alternative types of hammers particularly for use in cutting and grinding paper.
Figure 21:
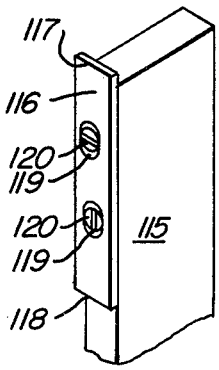

Particularly for the grinding of paper, further alternative hammers, as illustrated in FIGS. 20 and 21, may be pivotal or fixed and utilized for the lower rotor, particularly if the paper has previously been subdivided to an appreciable extent in the upper rotor. The hammer 108 of FIG. 20 is provided with a transverse blade 109 extending past the outer end of the hammer and having a perpendicular end extending to the rotation circle 68 of FIGS. 5 and 6, to provide a cutting edge 110 facing in the direction of rotation of the hammer. Blade 109 is mounted in a transverse slot 111 and held in position by a tapered pin 112 which is driven into a corresponding hole in the hammer, extending through an appropriate hole in the blade. Pin 112 may be driven from the hammer, when blade 109 is to be changed in position or replaced, from the opposite end. Thus, blade 109 may be reversed laterally in position to present the cutting edge, on the same end but opposite edge 110, in the position shown for the latter. Also, blade 109 may be reversed longitudinally to present one and then the other cutting edges at the opposite end, at the position shown for edge 110. Thus, blade 109 may be formed of thin material and may be sufficiently inexpensive that it may be discarded after all of the cutting edges are worn out. Preferably, blade 109 does not extend past the interception bars and for this purpose, an interception bar 78' may be provided with a convex edge 113 which corresponds in curvature to the hammer circle 68 of FIGS. 5 and 6. The blade 109 is preferably wider than the hammer, but the hammer narrower than the space between adjacent bars 78'. As the cutting edge 110 of the blade encounters a shred of paper, for instance, it will tend to cut it into smaller shreds, particularly when the paper is pushed against the screen S or a tooth 75 of one of the grinding segments G, G' or G''. With further subdivision or shredding thus accomplished, the shreds are readily pushed through the holes in the screen, with which the cutting edge and the blade cooperate.

The hammer 115 of FIG. 21 is provided with a transverse blade 116 similarly wider than the hammer and extending past its end, the blade having a cutting edge 117 which faces in the direction of rotation of the hammers and similarly cooperates with the screen S and segment teeth 75 to cut shreds of paper into smaller shreds. The blade may be reversed laterally and also may be reversed longitudinally to utilize a cutting edge 118 and its counterpart at the opposite end. Thus, blade 116 may have slots 119 so as to be mounted on the front face of the hammer, as by screws 120, with slots 119 being laterally centered so that the blade may be reversed laterally, as well as equidistant from the ends, so that the blade may be reversed longitudinally. Slots 119 are also elongated to permit lengthwise adjustment of the blade to compensate for wear and grinding, if desired, of each end, as after all four cutting edges have been worn.

Although a preferred embodiment has been illustrated and described and certain variations shown or indicated, it will be understood that other embodiments may exist and that various changes may be made, all without departing from the spirit and scope of this invention.

What is claimed is:

1. A hammermill construction comprising:

first and second rotors, each having hammers and at least said first rotor having pivoted hammers, the ends of said hammers, when extended or fixed during rotation describing a circle of a predetermined radius for each of said rotor;

means for supporting said rotors for rotation in the same direction about parallel horizontal axes but with the axis of the first rotor at a higher elevation than the axis of the second rotor, with a line between said axes being an acute angle to the horizontal and said axes being spaced apart along said line a distance greater than the sum of the radius of each said circle to prevent a hammer of one rotor from directly striking a radially opposite hammer of the other rotor but to permit a hammer of one rotor to strike a piece propelled by a hammer of the opposite rotor;

means for feeding objects or articles to be ground or subdivided to said first rotor; and intercepting means extending across the space between said rotors and between said hammers of said second rotor at a position spaced from the circle defined by the ends of the hammers of said first rotor but in a position to receive an impact from pieces or objects propelled by hammers of said first rotor.

2. A hammermill construction as defined in claim 1, wherein:

said intercepting means, at said line between said axes, is disposed inwardly from said circle defined by said hammers of said second rotor, whereby the ends of said hammers of said second rotor may extend beyond said intercepting means during movement past said intercepting means.

3. A hammermill construction as defined in claim 2, wherein:

said intercepting means comprises a series of parallel bars extending between said hammers of said second rotor, generally perpendicular to the line between said axes and interspersed between the planes of rotation of said hammers of said second rotor.

4. A hammermill construction as defined in claim 3, including:

impact corners of substantial thickness, positioned at front and rear to extend laterally in the area between said hammer circles and toward the area of closest approach between said circles.

5. A hammermill construction as defined in claim 1, wherein:

said means for feeding objects to said first rotor is adapted to supply said objects to an area extending generally across the width of said first rotor and opposite said second rotor.

6. A hammermill construction as defined in claim 5, including:

screen means on the underside of said second rotor for discharge of pieces reduced to a predetermined size or less.

7. A hammermill construction as defined in claim 6, including:

a support for said screen means including arcuate, circumferentially extending, laterally spaced bars engaging the underside of said screen.

8. A hammermill construction as defined in claim 5, including:

a gate essentially conforming in shape to said hammer circle of said first rotor and disposed adjacent and below said feeding means; and means for releasably urging said gate toward said first rotor, whereby said gate is adapted to be opened to release an object producing a predetermined pressure against said gate.

9. A hammermill construction as defined in claim 8, including:

resilient means for urging said gate toward said first rotor.

10. A hammermill construction as defined in claim 9, wherein:

said gate comprises an arcuate segment having a radius greater than said circle of said hammers of said first rotor; and means for pivoting said gate about a horizontal axis adjacent the underside of said feeding means.

11. A hammermill construction as defined in claim 1, wherein:

said first rotor is provided with laterally spaced individual hammers; and said second rotor is provided with laterally spaced sets of two adjacent hammers, with each hammer of a thickness on the order of one half the thickness of said hammers of said first rotor.

12. A hammermill construction as defined in claim 1, including:

means for rotating said first rotor at a predetermined speed; and means for rotating said second rotor at a higher speed than said first rotor.

13. A hammermill construction as defined in claim 12, wherein:

said rotating means rotates said first rotor at a speed of approximately 1000 to 1500 r.p.m.; and said rotating means rotates said second rotor at a speed of approximately 1800 to 2200 r.p.m.

14. A hammermill construction as defined in claim 12, wherein:

said first rotor is provided with laterally spaced, individual hammers; and said second rotor is provided with spaced sets of three adjacent hammers, with each of the three hammers having a thickness less than one third the thickness of the hammers of said first rotor.

15. A hammermill construction as defined in claim 12, wherein:

said second rotor is provided with laterally spaced hammers having a blade attached to the outer end thereof, said blade extending transversely to said hammer, having a width greater than the width of said hammer and having a cutting edge facing in the direction of movement of said hammer.

16. A hammermill as defined in claim 15, wherein:

said hammers of said second rotor are mounted on a shaft in fixed, non-pivotal relation to said shaft.

17. A hammermill construction as defined in claim 15, wherein:

said blade extends longitudinally of said hammer and is provided with at least one cutting edge at each end; and means attaching said blade to the front face of said hammer for longitudinal reversal of said blade and for longitudinal adjustment of said blade.

18. A hammermill construction as defined in claim 15, wherein:

said blade extends longitudinally of said hammer and is provided with at least one cutting edge at each end;

said hammer is provided with a transverse slot extending inwardly from the outer end of said hammer for receiving said blade; and means securing said blade in said slot for longitudinal reversal of said blade.

19. A hammermill construction as defined in claim 1, including:

means surrounding said first and second rotors except at said feeding means and said intercepting means, including means providing slots or discontinuities adjacent said hammer circles and cooperative with said hammers for comminution purposes;

pedestal means at each side of said rotors for supporting said rotors at elevated positions;

housing means substantially enclosing said rotors, being disposed at each side of said rotors, extending upwardly at the rear of said rotors to said feeding means and extending obliquely upwardly at the front of said rotors; and a pivoted panel engageable with the front oblique portion of said housing means and movable to a position permitting access to said surrounding means and said rotors.

20. A hammermill construction as defined in claim 19, wherein:

said front housing panel extends obliquely from a point adjacent the horizontal center of said second rotor to a point above said first rotor; and pivot means at the lower edge of said panel to permit said panel to be pivoted forwardly and downwardly.

21. A hammermill construction as defined in claim 20, wherein:

said means surrounding said rotors includes segments movable with said panel to positions exposing said hammers for inspection or replacement thereof.

22. A hammermill construction as defined in claim 21, wherein:

said housing includes a rear wall having doors pivotal outwardly to provide access to the rear of said surrounding means and rotors.

23. A hammermill construction as defined in claim 1, including:

means for rotating said first rotor at a predetermined speed;

means for rotating said second rotor at a higher speed than said first rotor;

a series of parallel bars extending between said hammers of said second rotor, generally perpendicular to the line between said axes and interspersed between the planes of rotation of said hammers of said second rotor to provide said intercepting means, said bars being disposed inwardly from said circle defined by said hammers of said second rotor, whereby the ends of said hammers of said second rotor may extend beyond said bars during movement past said bars;

impact corners of substantial thickness, positioned at front and rear to extend laterally in the area between said hammer circles and toward the area of closest approach between said circles;

said means for feeding objects to said first rotor adapted to supply said objects to an area extending generally across the width of said first rotor and from the rear side to an upper center position of said second rotor;

a gate comprising an arcuate segment having a radius greater than said circle of said hammers of said first rotor, having parallel, inwardly extending teeth and disposed adjacent and below said feeding means;

means for pivoting said gate about a horizontal axis;

resilient means for releasably urging said gate toward said first rotor, whereby said gate is adapted to be opened to release an object producing a predetermined pressure against said gate;

means surrounding said first and second rotors except at said feeding means and said intercepting means, including means providing slots or discontinuities adjacent said hammer circles and cooperative with said hammers for comminution purposes;

pedestal means at each side of said rotors for supporting said rotors at elevated positions;

housing means substantially enclosing said rotors, being disposed at each side of said rotors, extending upwardly at the rear of said rotors to said feeding means and extending obliquely upwardly at the front of said rotors;

a pivoted panel engageable with the front oblique portion of said housing means and movable to a position permitting access to said surrounding means and said rotors, said panel being separable from said housing means at a parting line which extends from the front of said housing and horizontally along the approximate centerline of said second rotor to an arcuate aperture for a central shaft of said second rotor, around said aperture to an upper, generally vertical position, upwardly to a position obliquely downward from the centerline of said first rotor, obliquely upward to an arcuate aperture for a shaft of said first rotor, around said aperture to an upper, generally vertical point and obliquely upwardly and forwardly;

hydraulic means for moving said panel between said position enclosing said rotors and said position when pivoted forwardly and downwardly;

segments having laterally extending teeth at the front of said rotors and movable with said panel to positions exposing said hammers for inspection or replacement thereof;

an arcuate grinding screen having apertures for grinding and discharge of material and disposed closely adjacent said circle of said second rotor and extending between points below the horizontal centerline thereof at the front and at the rear;

a guide having means for slidably receiving said screen for removal when said panel is pivoted forwardly and downwardly; and an arcuate grinding segment having transverse teeth and disposed between said screen and said horizontal centerline at the front, said guide means also engaging said segment and slidably receiving said segment for removal prior to removal of said screen.

24. A hammermill construction comprising:

first and second rotors, each having hammers and at least said first rotor having pivoted hammers, the ends of said hammers, when extended or fixed during rotation, describing a circle of a predetermined radius for each said rotor;

means for supporting said rotors for rotation in the same direction about parallel horizontal axes but with the axis of the first rotor at a higher elevation than the axis of the second rotor, with a line between said axes being an acute angle to the horizontal and said axes being spaced apart along said line a distance greater than the sum of the radius of each said circle to prevent a hammer of one rotor from directly striking a radially opposite hammer of the other rotor but to permit a hammer of one rotor to strike a piece propelled by a hammer of the opposite rotor;

means for feeding objects or articles to be ground or subdivided to said first rotor;

housing means enclosing said rotors including a front panel extending obliquely from a point adjacent the horizontal center of said second rotor to a point above said first rotor;

pivot means at the lower edge of said panel to permit said panel to be pivoted forwardly and downwardly;

an arcuate grinding screen having apertures for grinding and discharge of material and disposed closely adjacent said circle of said second rotor and extending between points below the horizontal centerline thereof at the front and at the rear; and a guide at each side of said second rotor having means for slidably receiving said screen for removal when said panel is pivoted forwardly and downwardly.

25. A hammermill as defined in claim 24, including:

an arcuate grinding segment having transverse ribs and disposed between said screen and said horizontal centerline at the front; and said guide means also engaging said segment and slidably receiving said segment for removal prior to removal of said screen.

* * * * *